US009512668B1

(12) United States Patent
Nissan

(10) Patent No.: US 9,512,668 B1
(45) Date of Patent: Dec. 6, 2016

(54) GARAGE DOOR EXTENSION SYSTEM FOR ALLOWING AIRFLOW

(71) Applicant: Edward Nissan, Tucson, AZ (US)

(72) Inventor: Edward Nissan, Tucson, AZ (US)

( * ) Notice: Subject to any disclaimer, the term of this patent is extended or adjusted under 35 U.S.C. 154(b) by 0 days.

(21) Appl. No.: 14/620,607

(22) Filed: Feb. 12, 2015

(51) Int. Cl.

| | |
|---|---|
| ***E06B 3/48*** | (2006.01) |
| ***E06B 9/06*** | (2006.01) |
| *E04F 10/00* | (2006.01) |
| *E06B 7/03* | (2006.01) |
| *E06B 9/52* | (2006.01) |
| *E04F 10/08* | (2006.01) |
| *E06B 9/17* | (2006.01) |
| *E06B 9/54* | (2006.01) |
| *E04F 10/10* | (2006.01) |

(52) U.S. Cl.
CPC ..... *E06B 9/06* (2013.01); *E04F 10/005* (2013.01); *E04F 10/08* (2013.01); *E04F 10/10* (2013.01); *E06B 7/03* (2013.01); *E06B 9/17* (2013.01); *E06B 9/52* (2013.01); *E06B 2009/546* (2013.01)

(58) Field of Classification Search
CPC ..... E06B 9/06; E06B 9/52; E06B 2009/527
USPC ..... 160/202, 211, 216, 222, 113, 180, 201,160/205, 89
See application file for complete search history.

(56) References Cited

U.S. PATENT DOCUMENTS 888,433 A * 5/1908 Thompson ..... E06B 3/925 160/202
1,593,183 A * 7/1926 Lindermayr ..... E06B 9/522 160/221
2,007,552 A * 7/1935 Vetterlein ..... E06B 3/925 160/189
2,154,421 A * 4/1939 Cunningham ..... B66B 13/06 160/202
2,531,797 A * 11/1950 Wellman ..... E04F 10/10 160/222
3,021,896 A * 2/1962 Buono ..... E05D 15/24 160/113
3,178,776 A * 4/1965 Stansberry ..... E06B 3/7001 160/201
3,218,091 A * 11/1965 Doak ..... B60P 3/32 160/222
3,562,983 A * 2/1971 Rector ..... B60P 3/32 280/768
3,564,770 A * 2/1971 Korbelic ..... E06B 7/02 160/222
3,698,465 A * 10/1972 Aberg ..... E06B 3/921 160/202
3,871,437 A * 3/1975 Jones ..... E05D 15/16 160/188
3,960,196 A * 6/1976 Berner ..... F24F 9/00 160/202
4,141,403 A * 2/1979 Church ..... E05D 15/24 160/201

(Continued)

*Primary Examiner* — Katherine Mitchell
*Assistant Examiner* — Johnnie A Shablack

(57) ABSTRACT

A garage door extension system for allowing airflow and preventing unwanted intrusion into a garage by a human or animal when a garage door is partially open features a garage door. An extension panel mount having a slot located in a horizontal component is mounted next to a garage door bottom. The horizontal component is located at an angle to the garage door. The system features a planar extension panel with an extension panel stop located on en extension panel top. The extension panel slides through the slot of the extension panel mount. The extension panel features a plurality of apertures located therein.

19 Claims, 7 Drawing Sheets

(56) References Cited

U.S. PATENT DOCUMENTS 4,378,043 A * 3/1983 Sorenson ..... E06B 7/03 160/201
4,653,566 A * 3/1987 Miale ..... E06B 9/54 160/113
5,120,273 A * 6/1992 Lin ..... E06B 7/02 454/195
5,155,936 A * 10/1992 Johnson ..... E06B 7/06 160/222
5,584,333 A * 12/1996 Torchetti ..... E06B 3/485 160/201
5,611,382 A * 3/1997 Sferra ..... E06B 9/52 160/113
5,662,371 A * 9/1997 Gera ..... B60J 3/0208 296/97.8
5,727,614 A * 3/1998 Lichy ..... E06B 9/581 160/201
5,848,630 A * 12/1998 Manzo ..... E05B 65/0021 160/113
5,860,465 A * 1/1999 Eastridge ..... E06B 3/485 160/113
5,884,684 A * 3/1999 Jefferson ..... B60J 3/0208 160/222
5,904,199 A * 5/1999 Messner ..... E06B 7/03 160/127
5,976,009 A * 11/1999 Achen ..... E06B 7/082 454/195
5,996,674 A * 12/1999 Gatewood ..... A47H 13/14 160/113
6,092,580 A * 7/2000 Lucas ..... E06B 3/485 160/113
6,415,844 B1 * 7/2002 Smith ..... E06B 9/52 160/216
6,557,614 B1 * 5/2003 Lampers ..... E06B 9/52 160/113
6,860,311 B1 * 3/2005 Minor ..... E05D 15/18 160/193
7,086,442 B1 * 8/2006 Esparza ..... E06B 9/52 160/113
7,143,803 B2 * 12/2006 Mitchell ..... E06B 7/02 160/113
7,207,372 B2 * 4/2007 Dorest ..... E06B 9/52 160/180
7,484,286 B2 * 2/2009 Fowler ..... E06B 3/7001 160/104
7,509,990 B1 * 3/2009 Milligan ..... E06B 9/24 160/113
D666,308 S * 8/2012 Sanchez ..... D25/48.8
8,453,705 B2 * 6/2013 Miller ..... E01F 13/04 160/113
8,615,970 B2 * 12/2013 Hoberman ..... E04B 1/86 160/187
8,662,971 B2 * 3/2014 Warner ..... E06B 7/08 454/195
8,756,878 B1 * 6/2014 Powell ..... E02D 31/00 280/768
2003/0106652 A1 * 6/2003 Ardoin ..... E06B 7/086 160/113
2005/0072074 A1 * 4/2005 Moore ..... E06B 9/52 52/204.5
2008/0230188 A1 * 9/2008 Albert ..... E06B 3/927 160/113
2009/0084507 A1 * 4/2009 Tescher ..... E06B 3/485 160/44
2013/0180675 A1 * 7/2013 Bates ..... E06B 9/52 160/381
2014/0069593 A1 * 3/2014 Gravel ..... E06B 3/485 160/89
2014/0190081 A1 * 7/2014 Wanjohi ..... A47G 29/126 49/25
2014/0196377 A1 * 7/2014 Muto ..... E06B 3/485 49/465

* cited by examiner

GARAGE DOOR EXTENSION SYSTEM FOR ALLOWING AIRFLOW

FIELD OF THE INVENTION

The present invention relates to garage doors and garage entry prevention systems.

BACKGROUND OF THE INVENTION

Nearly since the invention of the automobile, carports and garages have been around to provide shelter for automobiles and storage for other items such as motorcycles, lawnmowers, equipment, tools and supplies. Because a garage is not normally climate controlled, a garage door is sometimes opened to enhance air circulation in the garage. In some instances, the garage door is opened only a small amount to prevent people and large animals from entering the garage. In this scenario, small animals such as rats, snakes, snails, lizards, etc. may still enter. A need exists for a barrier that allows airflow to the garage, while preventing entry of people, large animals, and small animals. The present invention features a garage door extension system for allowing airflow and preventing unwanted intrusion into a garage by a human or animal when a garage door is partially open.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a garage door extension system for allowing airflow and preventing unwanted intrusion into a garage by a human or animal when a garage door is partially open. In some embodiments, the system comprises a garage door. In some embodiments, the system comprises an extension panel mount having a linear slot located in a horizontal component. In some embodiments, the extension panel mount is located at a garage door bottom. In some embodiments, the horizontal component is located at an angle to the garage door.

In some embodiments, the system comprises a planar extension panel. In some embodiments, an extension panel stop is located on an extension panel top. In some embodiments, the extension panel slides through the linear slot of the extension panel mount. In some embodiments, the extension panel stop will not pass through the linear slot. In some embodiments, the extension panel comprises a plurality of circulation apertures located therein.

In some embodiments, in a first, extended position, the garage door is raised to an elevated position and the extension panel extends through the linear slot towards a ground surface. In some embodiments, in a second, retracted position, the garage door is lowered to a closed position and the extension panel retracts through the linear slot.

DESCRIPTION OF PREFERRED EMBODIMENTS

Figure 1:
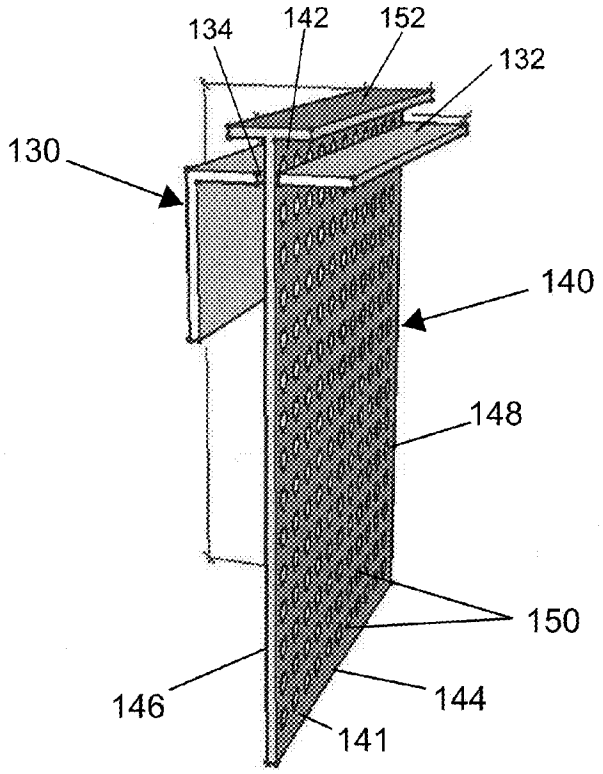
FIG. 1 shows a side perspective view of the extension panel mount and the extension panel of the present invention.
Figure 2:
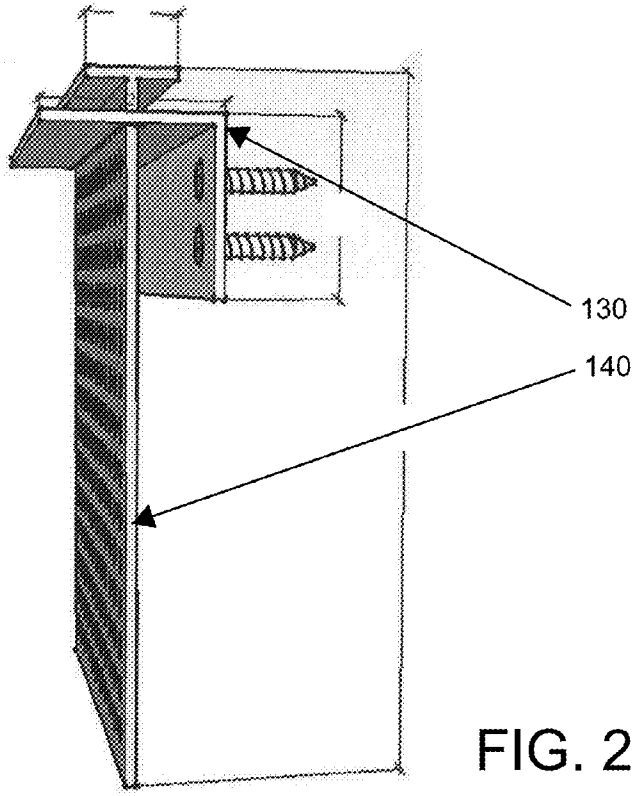
FIG. 2 shows a side perspective view of the extension panel mount and the extension panel of the present invention.
Figure 3:
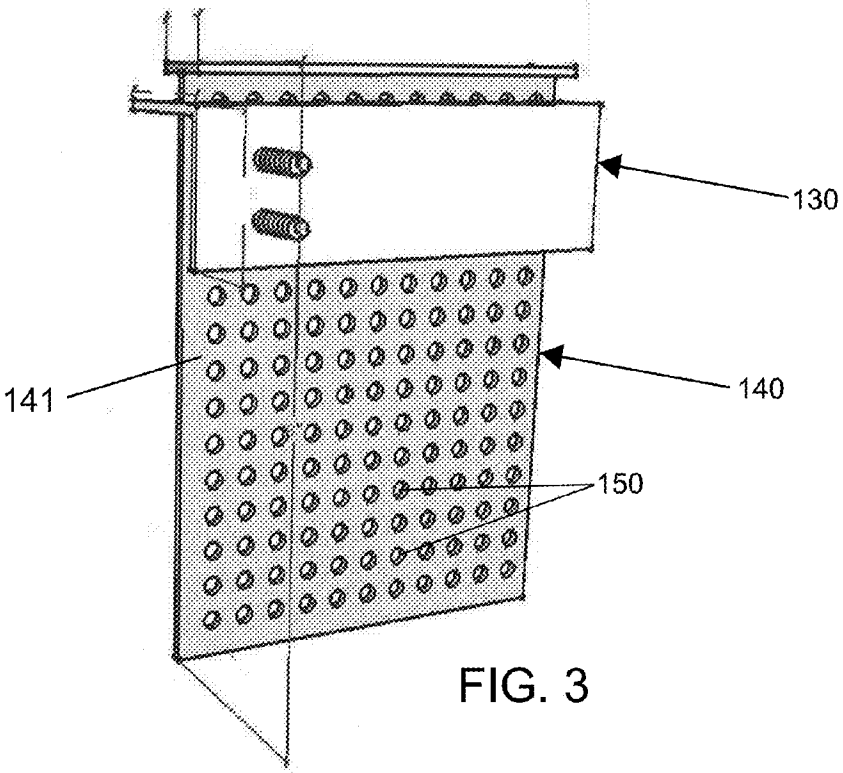
FIG. 3 shows a front perspective view of the extension panel mount and the extension panel of the present invention.
Figure 4A:
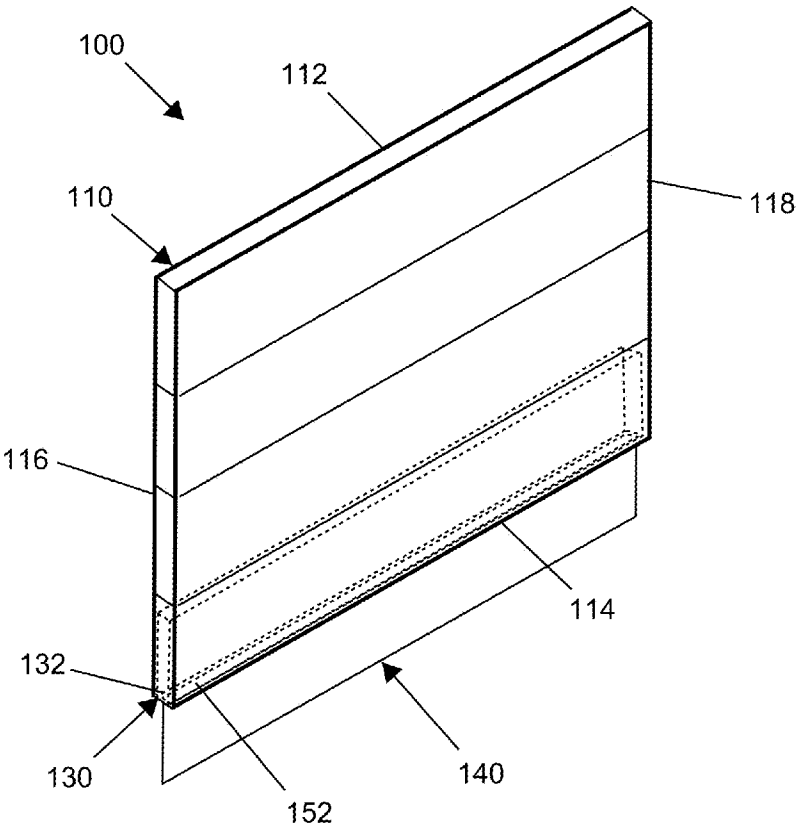
FIG. 4A shows a perspective view of the present invention featuring the extension panel mounted retractable into the garage door.
Figure 4B:
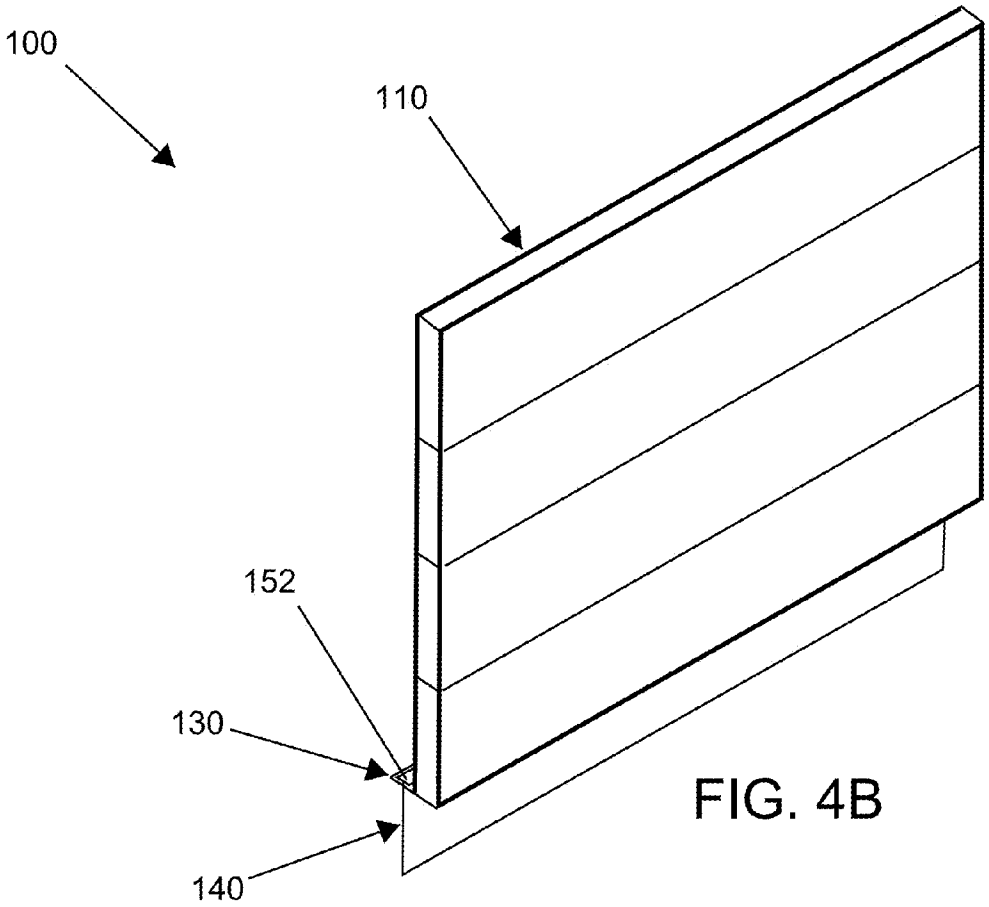
FIG. 4B shows a perspective view of the present invention featuring the extension panel mounted external to the garage door.

Following is a list of elements corresponding to a particular element referred to herein:

100 Garage door extension system
110 Garage door
112 Garage door top
114 Garage door bottom
116 Garage door first side
118 Garage door second side
130 Extension panel mount
132 Horizontal component
134 Linear slot
140 Extension panel
141 Extension panel face
142 Extension panel top
144 Extension panel bottom
146 Extension panel first side
148 Extension panel second side
150 Circulation aperture
152 Extension panel stop
160 Sliding panel
161 Sliding panel face
162 Sliding panel top
164 Sliding panel bottom
166 Sliding panel first side
168 Sliding panel second side Referring now to FIG. 1-6, the present invention features a garage door extension system (100) for allowing airflow and preventing unwanted intrusion into a garage by a human or animal when a garage door is partially open. In some embodiments, the system (100) comprises a garage door (110) having a garage door top (112), a garage door bottom (114), a garage door first side (116), and a garage door second side (118).

In some embodiments, the system (100) comprises an extension panel mount (130) having a linear slot (134) located in a horizontal component (132) therein. In some embodiments, the extension panel mount (130) comprises a cross-section of an "L". In some embodiments, the extension panel mount (130) can be affixed to an outside surface of the garage door (110). In some embodiments, the extension panel mount (130) can be affixed to a bottom surface of the garage door (110). In some embodiments, the extension panel mount (130) is located next to the garage door bottom (114). In some embodiments, the extension panel mount (130) is located close to the garage door bottom (114). In some embodiments, the horizontal component (132) is located at an angle to the garage door (110). In some embodiments, the angle is 90 degrees.

In some embodiments, the system (100) comprises a planar extension panel (140) having an extension panel top (142), an extension panel bottom (144), an extension panel first side (146), and an extension panel second side (148). In some embodiments, an extension panel stop (152) is located on the extension panel top (142). In some embodiments, the extension panel (140) comprises a cross-section of a "T". In some embodiments, the extension panel (140) slides through the linear slot (134) of the extension panel mount (130). In some embodiments, the extension panel stop (152) will not pass through the linear slot (134). In some embodiments, the extension panel (140) is spring biased to extend fully through the linear slot (134).

In some embodiments, an extension panel width measured from the extension panel first side (146) to the extension panel second side (148) is close to, but slightly smaller than a garage door width measured from the garage door first side (116) to the garage door second side (118).

In some embodiments, the extension panel (140) comprises a plurality of circulation apertures (150) located therein. In some embodiments, the extension panel (140) is perforated. In some embodiments, the extension panel (140) is mesh. In some embodiments, the circulation apertures (150) are round. In some embodiments, the circulation apertures (150) are rectangular. In some embodiments, the circulation apertures (150) are slots.

In some embodiments, in a first, extended position, the garage door (110) is raised to an elevated position. In some embodiments, the extension panel (140) extends through the linear slot (134) towards a ground surface.

In some embodiments, in a second, retracted position, the extension panel (140), the garage door (110) is lowered to a closed position. In some embodiments, the extension panel (140) retracts through the linear slot (134).

In some embodiments, the garage door (110) is a sectional overhead garage door (110). In some embodiments, the garage door (110) comprises a plurality of garage door panels pivotally located in series. In some embodiments, the garage door (110) comprises two garage door panels. In some embodiments, the garage door (110) comprises three garage door panels. In some embodiments, the garage door (110) comprises four garage door panels. In some embodiments, the garage door (110) is a roll-up door.

In some embodiments, the garage door (110) is unitary.

In some embodiments, the extension panel (140) is located within a hollow cavity located within the garage door (110).

In some embodiments, the extension panel (140) is located on an exterior surface of the garage door (110) via the extension panel mount (130). In some embodiments, the extension panel mount (130) can be mounted to a garage door (110) via screws or bolts.

In some embodiments, the extension panel (1400 may be constructed from any and all appropriate materials, for example, metals, woods, plastics, composites. In some embodiments, the extension panel (140) is constructed from a metal. In some embodiments, the extension panel (140) is constructed from a plastic.

In some embodiments, the extension panel (140) is constructed form a plurality of extension panel members, pivotally attached in series.

In some embodiments, the extension panel (140) is manually and slid into the first, extended position, or the second, retracted position via a user. In some embodiments, the user extends and retracts the extension panel (140).

In some embodiments, the extension panel (140) is slid into the first, extended position via the garage door (110) lifting from a ground surface. In some embodiments, gravitational forces act upon the extension panel (140). In some embodiments, the extension panel is positioned into the second, retracted position via contact with the ground surface from closing the garage door (110).

In some embodiments, the extension panel (140) slides into the first, extended position via activation of a motorized system, or the second, retracted position via activation of the motorized system. In some embodiments, the motorized system comprises a motor, a control, and a power supply operatively attached to the extension panel (140).

In some embodiments, the extension panel (140) is adjustably positioned into a third position between the first position and the second position.

In some embodiments, the system (100) comprises a planar sliding panel (160) having a sliding panel face (161), a sliding panel top (162), a sliding panel bottom (164), a sliding panel first side (166), and a sliding panel second side (168). In some embodiments, the sliding panel (160) comprises a plurality of circulation apertures (150) located therein. In some embodiments, the sliding panel face (161) is interfaces with and slides against the extension panel face (141).

In some embodiments, in a first panel position, the sliding panel (160) is positioned such that at least one circulation aperture (150) located on the sliding panel (160) at least partially aligns with one circulation aperture (150) located on the extension panel (140). In some embodiments, the first panel position provides circulation.

In some embodiments, in a second panel position, the sliding panel (160) is positioned such that no circulation aperture (150) located on the sliding panel at least partially aligns with one circulation aperture (150) located on the extension panel (140). In some embodiments, the second panel position provides no circulation.

In some embodiments, the sliding panel (160) is adjustably slid to a desired position between no alignment and full alignment with the circulation apertures (150) located on the sliding panel and the circulation apertures (150) located on the extension panel (140) to provide a desired level of circulation and airflow. In some embodiments, the sliding panel (160) slides in one or more tracks or channels.

In some embodiments, the present invention features a garage door extension system (100) for allowing airflow and preventing unwanted intrusion into a garage by a human or animal when a garage door is partially open. In some embodiments, the system (100) comprises a garage doer (110) having a garage door top (112), a garage door bottom (114), a garage door first side (116), and a garage door second side (118).

In some embodiments, the system (100) comprises a planar extension panel (140) having an extension panel face (141), an extension panel top (142), an extension panel bottom (144), an extension panel first side (146), and an extension panel second side (148). In some embodiments, the extension panel (140) comprises a plurality of circulation apertures (150) located therein.

In some embodiments, the extension panel (140) is located on the garage door (110).

In some embodiments, the extension panel (140) is located on the garage door bottom (114). In some embodiments, the extension panel (140) is the garage door bottom (114).

In some embodiments, the extension panel (140) is retractably located on the garage door bottom (114) and can be retracted into a cavity inside the garage door (110). In some embodiments, the extension panel (140) is retractably located on the garage door bottom (114) and can be retracted to a position parallel with the garage door (110), outside the garage door (110).

In some embodiments, the extension panel (140) is pivotally located on the garage door bottom (114), for example, on a hinge.

In some embodiments, the extension panel (140) is located on a garage door mid-section. In some embodiments, the garage door mid-section is located between the garage door top (112) and the garage door bottom (114). In some embodiments, the midsection is a middle panel of a segmented panel garage door (110). In some embodiments, the extension panel (140) is a garage door mid-section.

In some embodiments, the extension panel (140) is located on the garage door top (112). In some embodiments, the extension panel (140) is the garage door top (112).

In some embodiments, the extension panel (140) is located in a window aperture of the garage door (110). In some embodiments, the extension panel (140) takes the place of a garage door window.

In some embodiments, the system (100) comprises a planar sliding panel (160) having a sliding panel face (161), a sliding panel top (162), a sliding panel bottom (164), a sliding panel first side (166), and a sliding panel second side (168). In some embodiments, the sliding panel (160) comprises a plurality of circulation apertures (150) located therein. In some embodiments, the sliding panel face (161) interfaces with and slides against the extension panel face (141).

In some embodiments, in a first panel position, the sliding panel (160) is positioned such that at least one circulation aperture (150) located on the sliding panel (160) at least partially aligns with one circulation aperture (150) located on the extension panel (140).

In some embodiments, in a second panel position, the sliding panel (160) is positioned such that no circulation aperture (150) located on the sliding panel at least partially aligns with one circulation aperture (150) located on the extension panel (140).

Figure 5C:
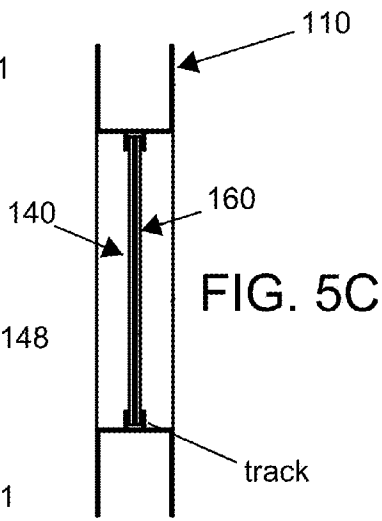
FIG. 5C shows a side view of an extension panel interfacing with a sliding panel installed in a garage door window.
Figure 5A:
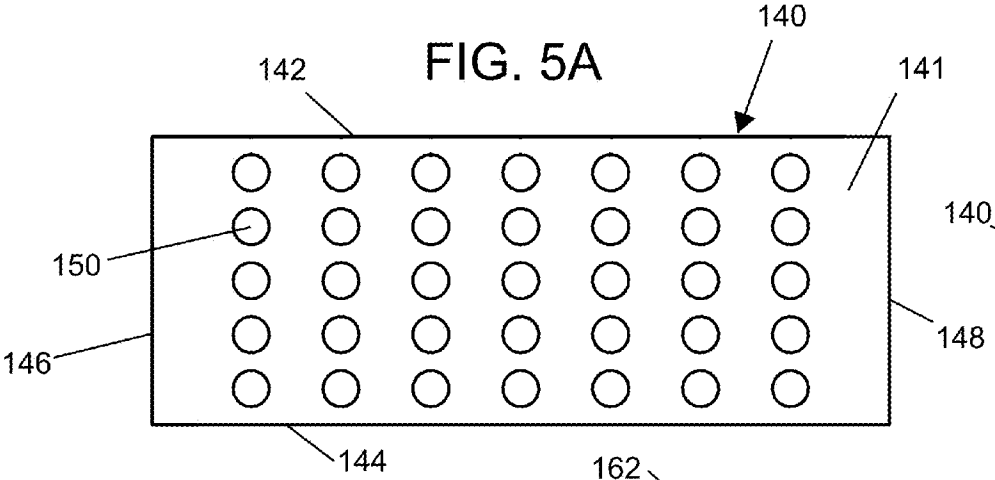
FIG. 5A shows a front view of an extension panel featuring the circulation apertures.
Figure 5B:
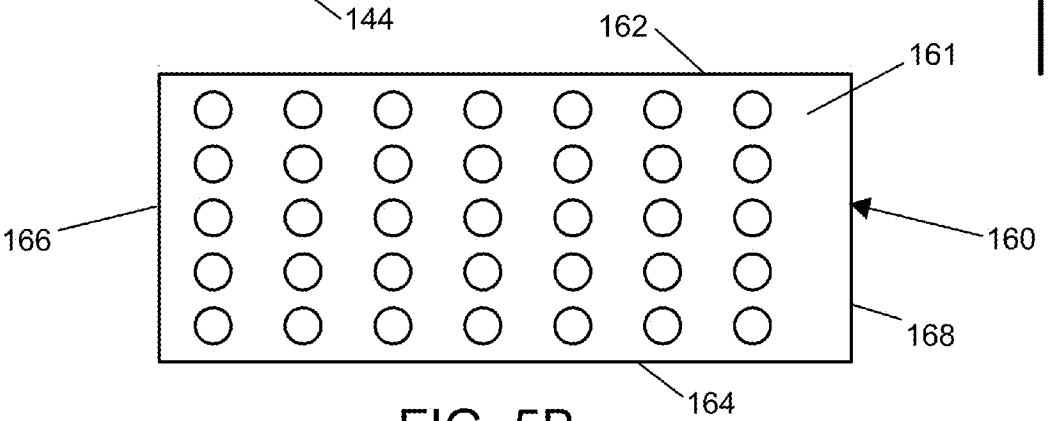
FIG. 5B shows a front view of a sliding panel featuring the circulation apertures.
Figure 6:
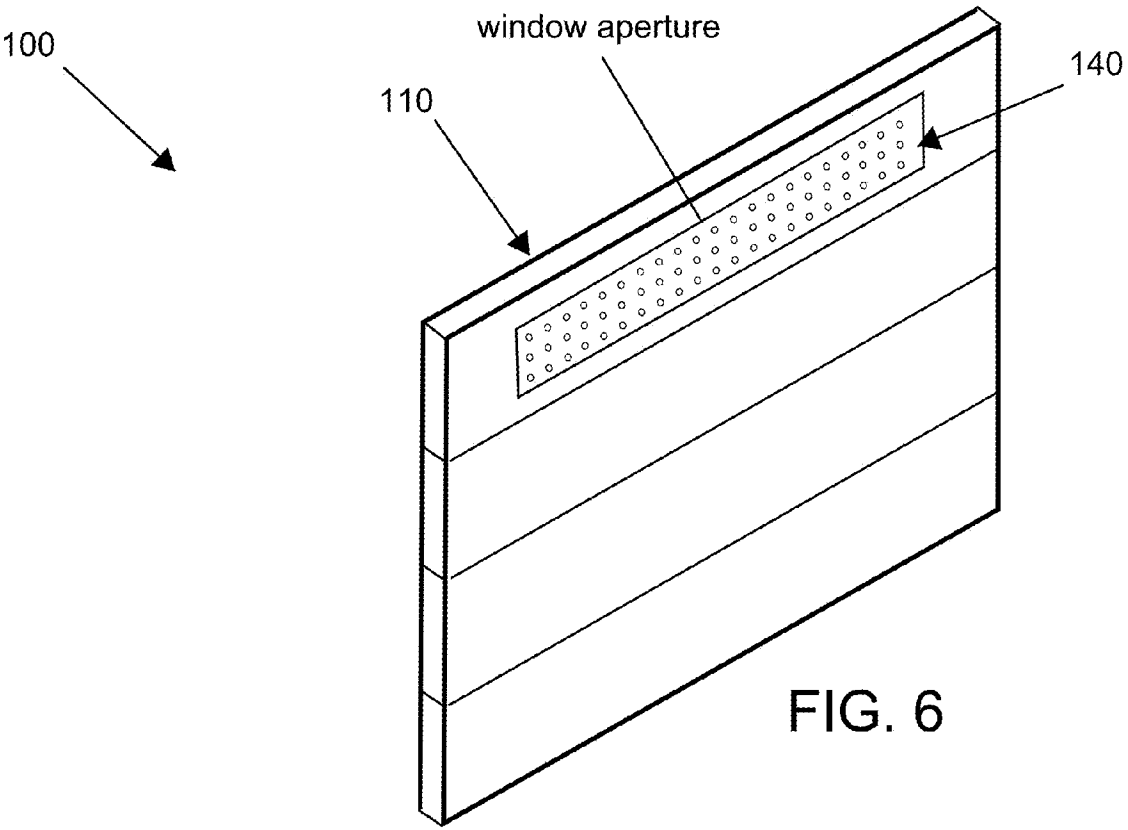
FIG. 6 shows a perspective view of the present invention featuring the extension panel mounted inside a window aperture of the garage door.

In some embodiments, the sliding panel (160) is a similar size to the extension panel (140), for example, the surface area of the extension panel face (141) is close in number to the surface area of the sliding panel face (161). In some embodiments, the sliding panel (160) is smaller in width from the sliding panel first side (166) to the sliding panel second side (168) than the extension panel (140) from the extension panel first side (146) to the extension panel second side (148) to allow for sliding and positioning the sliding panel (160) to align or cover the circulation apertures (150) in each. This is illustrated in FIG. 5A and FIG. 5B. In some embodiments, the width of the sliding panel (160) is determined to provide stopping positions for aligning the circulation apertures (150) in the first panel position and the second panel position. In some embodiments, the extension panel (140) and the sliding panel (160) are similar or equal in height.

In some embodiments, a plurality of sliding panels (160) is used with an extension panel (140), for example two, three or four sliding panels (160) are used to adjustably cover a single extension panel (140).

In some embodiments, the extension panel (140) is fixed onto the garage door (110) as a part of the garage door. In some embodiments, the extension panel (140) is fixed onto the garage door (110) as a non-retracting, non-pivoting part of the garage door.

In some embodiments, the sliding panel (160) is solid and does not contain circulation apertures (150).

In some embodiments, the present invention features permanent circulation holes integrated into a garage door or the ability to install the extension panel as a window to any garage door. In some embodiments, a panel with holes and a second panel with holes that slides, when the holes align, allows circulation into the garage. In some embodiments, when the solid area of the second panel covers the fixed panel with holes than there is no air circulation.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A garage door extension system (100) for allowing airflow and preventing unwanted intrusion into a garage by a human or animal when a garage door is partially open, wherein the system (100) comprises:

(a) a garage door (110) having a garage door top (112), a garage door bottom (114), garage door first side (116), and a garage door second side (118);

(b) an extension panel mount (130) having a slot (134) disposed in a horizontal component (132) therein, wherein the extension panel mount (130) is disposed adjacent to the garage door bottom (114), wherein the horizontal component (132) is disposed at an angle to the garage door (110); wherein the extension panel mount (130) is mounted to an exterior surface of the garage door (110) via screws or bolts; and (c) a planar extension panel (140) having an extension panel face (141), an extension panel top (142), an extension panel bottom (144), an extension panel first side (146), and an extension panel second side (148), wherein the extension panel mount (130) prevents the extension panel (140) from sliding against a surface of the garage door (110), wherein an extension panel stop (152) is disposed on the extension panel top (142), wherein the extension panel (140) is slidably disposed through the slot (134) of the extension panel mount (130), wherein the extension panel stop (152) will not pass through the slot (134), wherein the extension panel (140) comprises a plurality of apertures (150) disposed therein, wherein the apertures are serially distributed and span from the extension panel top (142) to the extension panel bottom (144);

wherein in a first, extended position, the garage door (110) is raised to an elevated position, wherein the extension panel (140) extends through the slot (134) towards a ground surface;

wherein in a second, retracted position, the extension panel (140), the garage door (110) is lowered to a closed position, wherein the extension panel (140) retracts through the slot (134);

(d) a planar sliding panel (160) having a sliding panel face (161), a sliding panel top (162), a sliding panel bottom (164), a sliding panel first side (166), and a sliding panel second side (168), wherein the sliding panel (160) comprises a plurality of apertures (150) disposed therein, wherein the apertures are serially distributed and span from the sliding panel top (162) to the sliding panel bottom (164), wherein the sliding panel face (161) is interfacingly and slidably disposed against the extension panel face (141), wherein in a first panel position, the sliding panel (160) is slidably positioned such that at least one aperture (150) disposed on the sliding panel (160) at least partially aligns with one aperture (150) disposed on the extension panel (140), wherein in a second panel position, the sliding panel (160) is slidably positioned such that no aperture (150) disposed on the sliding panel (160) at least partially aligns with one aperture (150) disposed on the extension panel (140);

wherein the sliding panel (160) is smaller in width from the sliding panel first side (166) to the sliding panel second side (168) than the extension panel (140) from the extension panel first side (146) to the extension panel second side (148) to allow for sliding and positioning the sliding panel (160) to align or cover all the circulation apertures (150) on the extension panel (140) and the sliding panel (160).

2. The system (100) of claim 1, wherein the garage door (110) is a sectional roll-up garage door (110), wherein the garage door (110) comprises a plurality of garage door panels pivotally disposed in series.

3. The system (100) of claim 1, wherein the garage door (110) is unitary.

4. The system (100) of claim 1, wherein the extension panel (140) is disposed within a hollow cavity disposed within the garage door (110).

5. The system (100) of claim 1, wherein the extension panel (140) is disposed on an exterior surface of the garage door (110).

6. The system (100) of claim 1, wherein the extension panel (140) is constructed from a metal.

7. The system (100) of claim 1, wherein the extension panel (140) is constructed from a plastic.

8. The system (100) of claim 1, wherein the extension panel (140) is manually and slidably positioned into the first, extended position, or the second, retracted position via a user.

9. The system (100) of claim 1, wherein the extension panel (140) is slidably positioned into the first, extended position via the garage door (110) lifting from a ground surface, wherein gravitational forces act upon the extension panel (140), or the second, retracted position via contact with the ground surface from closing the garage door (110).

10. The system (100) of claim 1, wherein the extension panel (140) is slidably positioned into the first, extended position via activation of a motorized system, or the second, retracted position via activation of the motorized system.

11. The system (100) of claim 1, wherein the extension panel (140) is adjustably positionable in a third position between the first position and the second position.

12. A garage door extension system (100) for allowing airflow and preventing unwanted intrusion into a garage by a human or animal when a garage door is partially open, wherein the system (100) comprises:

(a) a garage door (110) having a garage door top (112), a garage door bottom (114), a garage door first side (116), and a garage door second side (118); and (b) a planar extension panel (140) having an extension panel face (141), an extension panel top (142), an extension panel bottom (144), an extension panel first side (146), and an extension panel second side (148), wherein the extension panel (140) comprises a plurality of apertures (150) disposed therein, wherein the apertures are serially distributed and span from the extension panel top (142) to the extension panel bottom (144);

wherein the extension panel (140) is disposed on the garage door (110);

(c) a planar sliding panel (160) having a sliding panel face (161), a sliding panel top (162), a sliding panel bottom (164), a sliding panel first side (166), and a sliding panel second side (168), wherein the sliding panel (160) comprises a plurality of apertures (150) disposed therein, wherein the apertures are serially distributed and span from the sliding panel top (162) to the sliding panel bottom (164), wherein the sliding panel face (161) is interfacingly and slidably disposed against the extension panel face (141), wherein in a first panel position, the sliding panel (160) is slidably positioned such that at least one aperture (150) disposed on the sliding panel (160) at least partially aligns with one aperture (150) disposed on the extension panel (140), wherein in a second panel position, the sliding panel (160) is slidably positioned such that no aperture (150) disposed on the sliding panel (160) at least partially aligns with one aperture (150) disposed on the extension panel (140);

wherein the sliding panel (160) is smaller in width from the sliding panel first side (166) to the sliding panel second side (168) than the extension panel (140) from the extension panel first side (146) to the extension panel second side (148) to allow for sliding and positioning the sliding panel (160) to align or cover all the circulation apertures (150) on the extension panel (140) and the sliding panel (160).

13. The system of claim 12, wherein the extension panel (140) is disposed on the garage door bottom (114).

14. The system of claim 12, wherein the extension panel (140) is retractably disposed on the garage door bottom (114).

15. The system of claim 12, wherein the extension panel (140) is pivotally disposed on the garage door bottom (114).

16. The system of claim 12, wherein the extension panel (140) is disposed on a garage door mid-section, wherein the garage door mid-section is disposed between the garage door top (112) and the garage door bottom (114).

17. The system of claim 12, wherein the extension panel (140) is disposed on garage door top (112).

18. The system of claim 12, wherein the extension panel (140) is disposed in a window aperture of the garage door (110).

19. A garage door extension system (100) for allowing airflow and preventing unwanted intrusion into a garage by a human or animal when a garage door is partially open, wherein the system (100) consisting of:

(a) a garage door (110) having a garage door top (112), a garage door bottom (114), a garage door first side (116), and a garage door second side (118);

(b) an extension panel mount (130) having a slot (134) disposed in a horizontal component (132) therein, wherein the extension panel mount (130) is disposed adjacent to the garage door bottom (114), wherein the horizontal component (132) is disposed at an angle to the garage door (110); wherein the extension panel mount (130) is mounted to an exterior surface of the garage door (110) via screws or bolts; and (c) a planar extension panel (140) having an extension panel face (141), an extension panel top (142), an extension panel bottom (144), an extension panel first side (146), and an extension panel second side (148), wherein the extension panel mount (130) prevents the extension panel (140) from sliding against a surface of the garage door (110), wherein an extension panel stop (152) is disposed on the extension panel top (142), wherein the extension panel (140) is slidably disposed through the slot (134) of the extension panel mount (130), wherein the extension panel stop (152) will not pass through the slot (134), wherein the extension panel (140) consisting of a plurality of apertures (150) disposed therein, wherein the apertures are serially distributed and span from the extension panel top (142) to the extension panel bottom (144);

wherein in a first, extended position, the garage door (110) is raised to an elevated position, wherein the extension panel (140) extends through the slot (134) towards a ground surface;

wherein in a second, retracted position, the extension panel (140), the garage door (110) is lowered to a closed position, wherein the extension panel (140) retracts through the slot (134);

(d) a planar sliding panel (160) having a sliding panel face (161), a sliding panel top (162), a sliding panel bottom (164), a sliding panel first side (166), and a sliding panel second side (168), wherein the sliding panel (160) consisting of a plurality of apertures (150) disposed therein, wherein the apertures are serially distributed and span from the sliding panel top (162) to the sliding panel bottom (164), wherein the sliding panel face (161) is interfacingly and slidably disposed against the extension panel face (141), wherein in a first panel position, the sliding panel (160) is slidably positioned such that at least one aperture (150) disposed on the sliding panel (160) at least partially aligns with one aperture (150) disposed on the extension panel (140), wherein in a second panel position, the sliding panel (160) is slidably positioned such that no aperture (150) disposed on the sliding panel (160) at least partially aligns with one aperture (150) disposed on the extension panel (140);

wherein the sliding panel (160) is smaller in width from the sliding panel first side (166) to the sliding panel second side (168) than the extension panel (140) from the extension panel first side (146) to the extension panel second side (148) to allow for sliding and positioning the sliding panel (160) to align or cover all the circulation apertures (150) on the extension panel (140) and the sliding panel (160).

* * * * *